US006196557B1

(12) United States Patent
Gérard

(10) Patent No.: US 6,196,557 B1
(45) Date of Patent: Mar. 6, 2001

(54) IN-LINE ROLLER SKATE

(75) Inventor: Claude Millot Gérard, Paris (FR)

(73) Assignee: Rolsoft, Paris (FR)

( * ) Notice: Subject to any disclaimer, the term of this patent is extended or adjusted under 35 U.S.C. 154(b) by 0 days.

(21) Appl. No.: 09/125,830

(22) PCT Filed: Apr. 3, 1998

(86) PCT No.: PCT/FR98/00683

§ 371 Date: Aug. 21, 1998

§ 102(e) Date: Aug. 21, 1998

(87) PCT Pub. No.: WO98/48909

PCT Pub. Date: Nov. 5, 1998

(30) Foreign Application Priority Data

Apr. 25, 1997 (FR) ..... 97 05125

(51) Int. Cl.[7] ..... A63C 17/06
(52) U.S. Cl. ..... 280/11.28; 250/11.27
(58) Field of Search ..... 280/87.041, 87.042, 280/11.22, 11.27, 11.28, 842, 11.26; 301/5.3

(56) References Cited

U.S. PATENT DOCUMENTS

| | | | | |
|---|---|---|---|---|
| 341,999 | * | 5/1886 | Davis | 280/11.28 |
| 2,644,692 | * | 7/1953 | Kahlert | 280/11.28 |
| 4,272,090 | * | 6/1981 | Wheat | 280/11.28 |
| 5,135,244 | | 8/1992 | Allison | 280/11.28 |
| 5,193,827 | * | 3/1993 | Olson | 280/11.26 |
| 5,263,725 | * | 11/1993 | Gesmer et al. | 280/11.28 |
| 5,342,071 | * | 8/1994 | Soo | 280/11.28 |
| 5,405,156 | * | 4/1995 | Gonella | 280/11.28 |
| 5,582,418 | * | 12/1996 | Closser | 280/11.28 |
| 5,645,288 | * | 7/1997 | Lu | 280/11.26 |
| 5,690,344 | * | 11/1997 | Chen | 280/11.28 |
| 5,704,620 | * | 1/1998 | Oliemans et al. | 280/11.28 |
| 6,029,984 | * | 2/2000 | Pivotto | 280/11.28 |

FOREIGN PATENT DOCUMENTS

| | | | | |
|---|---|---|---|---|
| 654100 | * | 12/1937 | (DE) | 280/11.28 |
| 0778058 | | 11/1996 | (EP) . | |
| 2435958 | * | 5/1980 | (FR) | 280/11.28 |
| 1210864 | * | 2/1986 | (SU) | 280/11.28 |
| 8911894 | | 12/1989 | (WO) . | |
| 93/12847 | * | 7/1993 | (WO) | 280/11.28 |
| 9626775 | | 9/1996 | (WO) . | |
| 9710033 | | 3/1997 | (WO) . | |
| 9718019 | | 5/1997 | (WO) . | |

* cited by examiner

*Primary Examiner*—Frank Vanaman

(57) ABSTRACT

A skate with in-line rollers or wheels (1) comprises a chassis (5), a shoe (4) mounted on the chassis, a front wheel unit (6) and a rear wheel unit (9), the units (6, 9) pivoting on the chassis (5) about respective pins (13, 14) transverse to the direction of movement of the skate (1). A coupling link (15) is provided for coupling the wheel units (6, 9) together in such manner as to cause them to pivot together and in the same direction about their respective pivots pins (13, 14). This skate can flexibly cross discontinuities in the ground of small height or depth with all of the wheels (7, 10, 11) remaining in contact with the ground.

20 Claims, 5 Drawing Sheets

IN-LINE ROLLER SKATE

BACKGROUND OF THE INVENTION

1. Field of the Invention

The invention concerns in-line roller skates including a chassis on which a shoe is mounted.

2. Description of Related Art

Roller skates can be classified into two main families, namely, skates in which the rollers or wheels are disposed on axles, generally two axles, one behind the other, and skates in which the rollers or wheels are mounted individually in-line one behind the other, this type of skate often being called an "in-line skate".

In-line skates often have three or more wheels the respective rotation axes of which are at different heights so that only the wheel or wheels under the middle of the foot are in contact with the ground when the skater's foot is parallel to the ground.

The wheels at the ends of the skate then have a diameter and/or are mounted in such a manner that they come into contact with the ground only when the skate is inclined towards the front or towards the rear, which makes the skate manoeuvrable and enables easy and fast changes of direction.

However, this arrangement of the wheels makes the skate less stable so it does not readily keep to the required trajectory, in particular in curves.

In a curve the skate is inclined laterally and also tends to pivot relative to the bearing point of the wheel that is in contact with the ground. Accordingly, at least with three in-line wheels, it is as if the skate is in contact with the ground at a single point, giving it three degrees of freedom in rotation. These skates are therefore intended for very experienced skaters wanting to perform particular figures.

For ordinary use by inexperienced skaters, skates in which all the wheels touch the ground at the same time are preferable, because they have the advantage of being unconditionally stable.

This being so, they have the drawback of not maintaining simultaneous contact of all the wheels with irregular ground and of making contact with the ground more brutal and therefore less comfortable when executing figures.

To overcome this drawback, document WO 96/26 775 teaches the provision of an in-line roller skate having a chassis mounted under the sole of a shoe and two bogies in each of which two wheels are mounted rotatably and in-line, the bogies themselves pivoting about an axis transverse to the alignment of the wheels. The bogies are spring-loaded into a position in which all the wheels are at the same height. Although this arrangement offers the skater some comfort, it can also cause a nose dive or jamming of the front of the skate if the latter has to pass over a discontinuity in the ground on its path. Especially if the discontinuity is sudden, the front wheel then strikes it or is stopped by it, tilting the skate towards the front. Moreover, on starting off, when the skater generally "pushes" backward with the toes, raising the heel, the front bogie will remain in contact with the ground and tend to shoot out towards the rear.

The aim of the present invention is to remedy the disadvantages of prior art roller skates.

SUMMARY OF THE INVENTION

The invention therefore consists in a skate with in-line wheels comprising a chassis, a shoe mounted on the chassis, a front wheel unit and a rear wheel unit, said units pivoting on the chassis about respective pins transverse to the direction of movement of the skate, characterised in that coupling means are provided for coupling said units together in such manner as to cause them to pivot together and in the same direction about their respective pivot pins.

By virtue of these features the skater feels more in control because the wheels remain practically always in contact with the ground, even on irregular ground, sudden discontinuities being traversed smoothly. The skate of the invention is therefore particularly suitable for use by beginners and is very comfortable in use.

BRIEF DESCRIPTION OF THE DRAWINGS

Other features and advantages of the present invention will become apparent in the following description given by way of example only and with reference to the accompanying drawings, in which.

DETAILED DESCRIPTION

Figure 1:
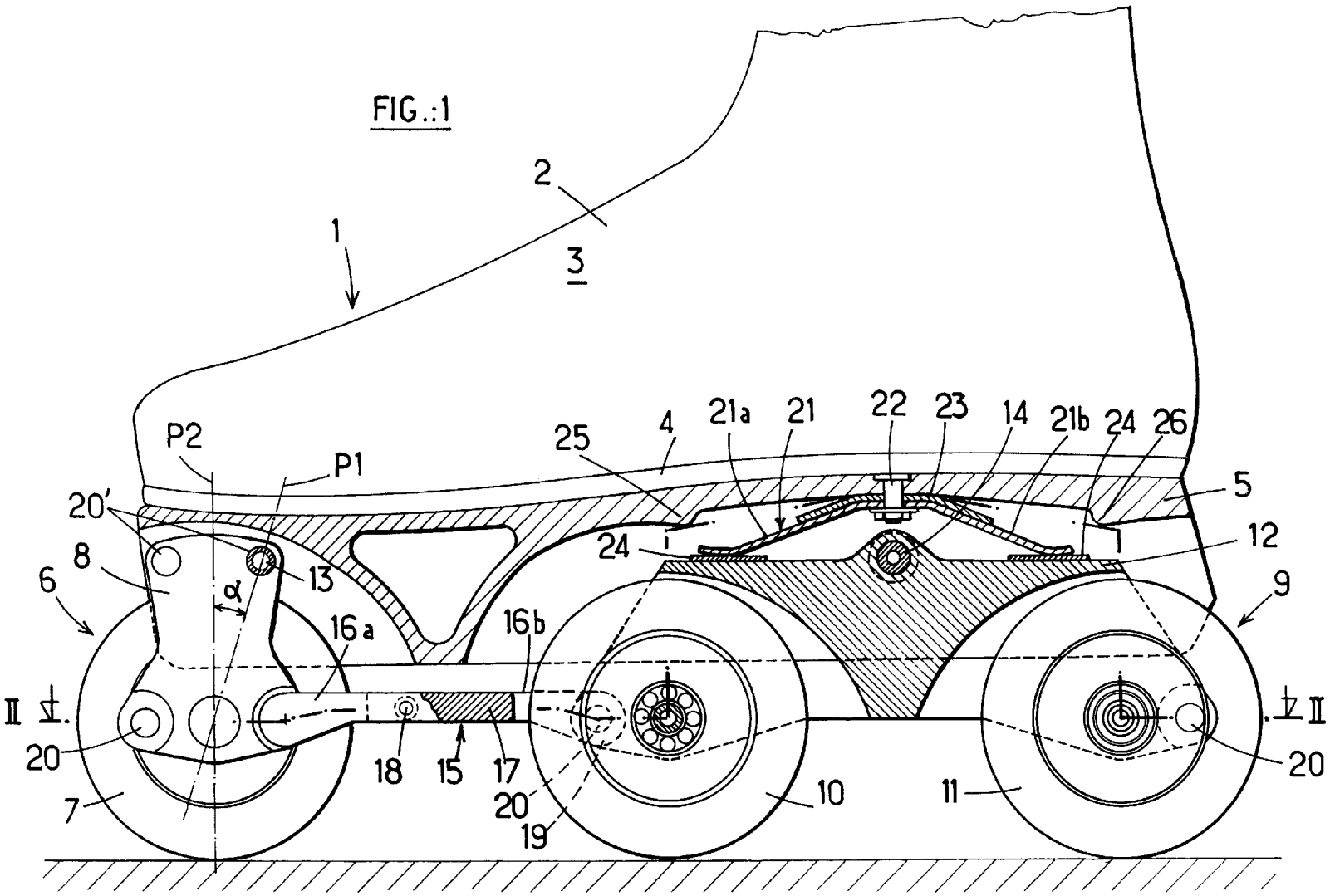
FIG. 1 is a profile view partly in section of one embodiment of the skate in accordance with the invention resting on flat, horizontal and regular round.
Figure 2:
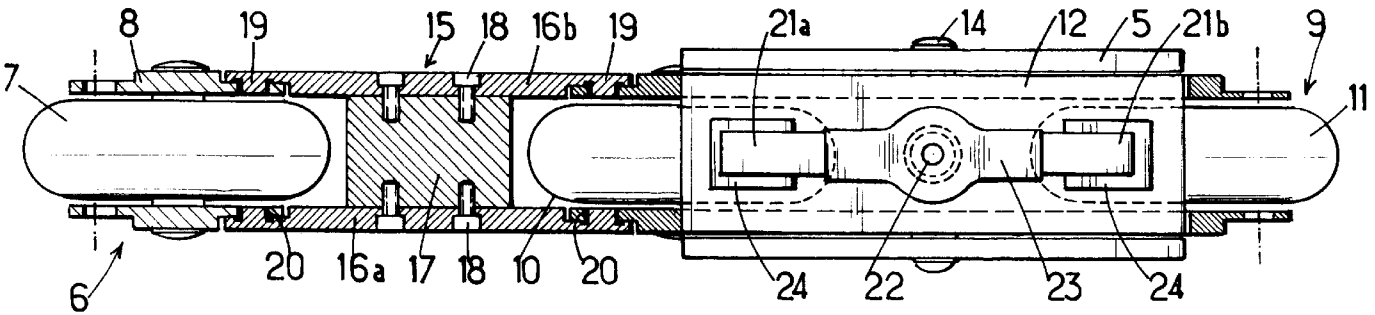
FIG. 2 is a top view of the skate partly in section taken along the line II—II in FIG. 1.
Figure 3:
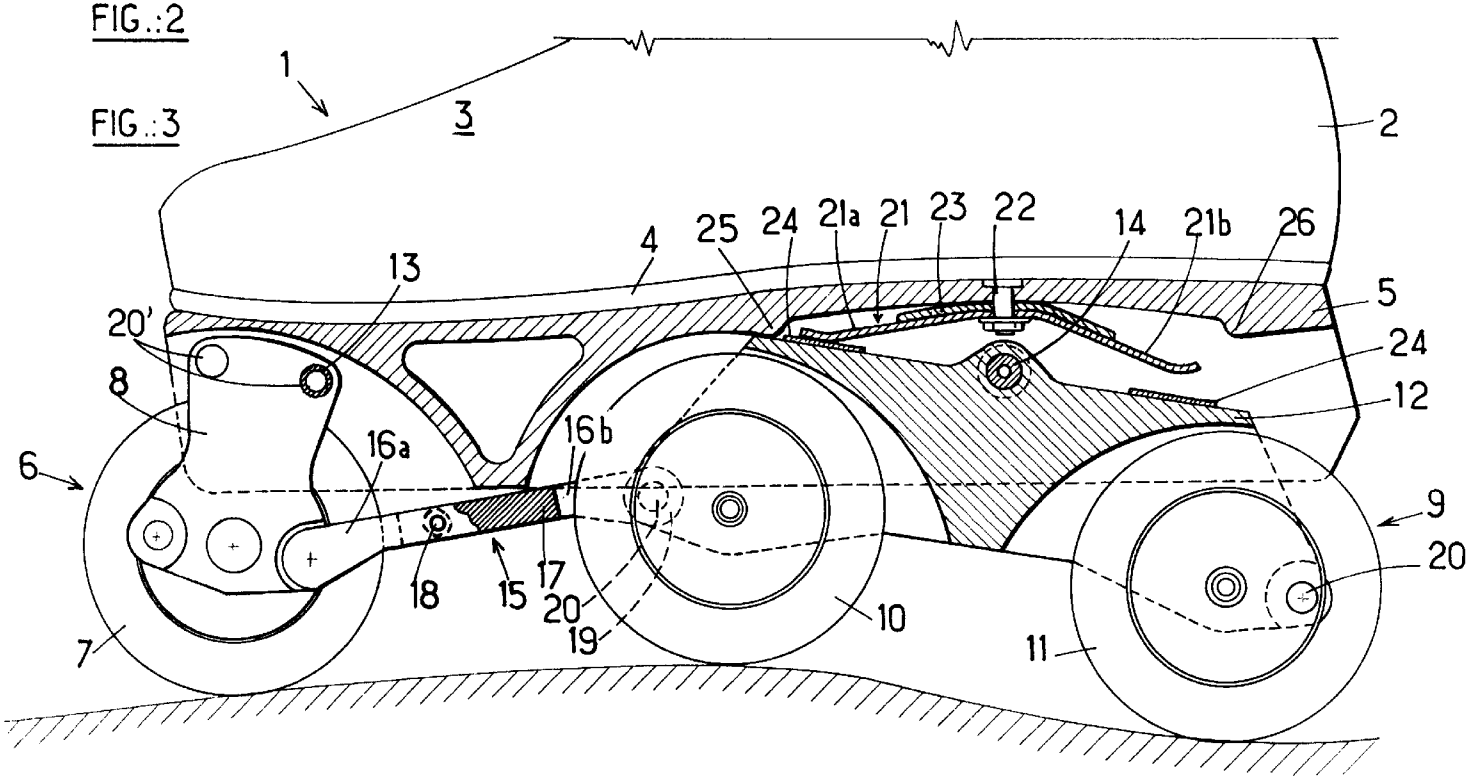
FIG. 3 is a profile view similar to FIG. 1 and representing the skate travelling over ground featuring irregularities.

FIGS. 1 through 3 show an in-line roller skate 1 constituting one embodiment of the invention. It includes a shoe 2 which includes an upper 3 and a sole 4.

The shoe 2 is fixed to a chassis 5 which has an inverted U-shape cross-section throughout its length. The shoe 2 is fixed to it by any known means such as screws, rivets, glue or by welding. If the chassis is made of a plastics material it can be moulded in one piece with the shoe 2 or the sole 4.

The skate 1 of the invention has a front wheel unit 6 with a front wheel 7 rotatably mounted in a front yoke 8 and a rear wheel unit 9 with two rear wheels 10 and 11 rotatably mounted in a common rear yoke 12. The front and rear wheels 7, 10 and 11 are in-line.

All the wheels of the skate preferably have the same diameter. By way of non-limiting example this diameter can be 80 mm.

The front yoke 8 pivots on the chassis 5 about a pin 13 transverse to the direction of movement of the skate 1. Similarly, the rear yoke 12 pivots on the chassis 5 about a pin 14 that is also transverse to the direction of movement of the skate 1.

FIG. 1 shows that when the skate is resting on flat horizontal regular ground the pivot pin 13 is set back in the direction of forward movement of the skate 1 and is in a plane P1 inclined rearwardly at an angle a to the vertical plane P2 passing through the rotation axis of the front wheel 7. The angle a is advantageously such that $0 \leqq \alpha \leqq 30°$ and preferably $0 \leqq \alpha \leqq 15°$.

According to one essential feature of the invention the skate includes coupling means linking the front yoke 8 to the rear yoke 12. The coupling means are preferably formed by a double link 15, as shown here. The ends of the link 15 are respectively articulated to the yokes 8 and 12.

FIG. 2 shows that when seen in plan view the double link 15 is in the form of a stretcher with side-members 16*a* and 16*b* joined together by a connecting block 17 and screws 18.

The ends of the uprights 16*a* and 16*b* have lateral studs 19 projecting into corresponding holes 20 in the front and rear yokes 8 and 12 to achieve the articulation of the double link to the yokes.

Alternatively the double link 15 can be made (for example moulded) in one piece.

Note that holes 20 are provided at each of the front and rear ends of the yokes 8 and 12 so that the wheel units are reversible. The same applies to the yoke 8 which includes two holes 20' through which the pin 13 passes and symmetrical about the plane P2.

The skate also includes return spring means disposed between the rear yoke 12 and the chassis 5. In the embodiment of FIGS. 1 through 3 the return spring means comprise a leaf spring 21 fixed under the chassis 5 by means of a rivet 22 with one or more rigid plates 23 between them. The leaf spring 21 extends longitudinally an has two elastic branches 21*a* and 21*b* bearing on the top face of the yoke 12, this face being protected against wear by plates 24 which are fixed (for example glued) to it.

In a variant that is not shown the return spring means are fixed to the rear yoke 12.

Two abutments 25 and 26 are formed on the chassis 5 in vertical alignment with the rear ends of the top face of the yoke 12. They are designed to limit forward and rearward movement of the yokes to a certain amount (for example 1 cm) on either side of the intermediate position shown in FIG. 1, in the case of the front and rear ends of the top face of the yoke 12.

How the roller skate of the invention works is clear from FIGS. 1 through 3.

On flat horizontal ground (FIG. 1) the three wheels 7, 10 and 11 are in contact with the ground. The double link 15 is in the horizontal plane passing through the axes of the front and rear wheels 7, 10 and 11.

When the front wheel of the skate 1 encounters an upward discontinuity, for example a small bump, the front wheel 7 tends to ride up the discontinuity, which initially pivots the front yoke 8 about pin 13 in the anticlockwise direction relative to the chassis 5 (as seen in FIGS. 1 and 3). This pivoting causes the rear yoke 12 to pivot about pin 14 at the same time and in the same direction, by virtue of the coupling between the yokes 8 and 12 assured by the double link 15. Accordingly, provided that the discontinuity is not too high (which is often the case), all the wheels remain in contact with the ground.

If during this phase the skater presses lightly on the front of the skate, the front wheel will remain in contact with the discontinuity. Nevertheless, because of the coupling assured by the double link 15, the intermediate wheel 10 will rise up to begin climbing over the discontinuity, which it can do flexibly, while the other two wheels remain in contact with the ground.

When the front wheel 7 has passed the bump the two rear wheels, still in contact with the ground, also pass the obstacle flexibly because of the pivoting capability of the rear yoke 12. In the final analysis, the skater will hardly notice the bump, being able to acquire the necessary skill very quickly.

The converse reasoning applies to crossing a dip in the ground.

It will nevertheless be understood that the variation in height of the discontinuities must remain within certain limits, larger discontinuities having to be absorbed by the usual upward or downward movement of the skater's foot. However, as long as these limiting variations are not present, the skate of the invention enables flexible crossing of discontinuities, which is less fatiguing and more comfortable for the skater.

Although conventional in-line skates require the wheels to be permutated to prevent irregular wear, the simultaneous contact with the ground of all the wheels in accordance with the invention means that they all operate under the same conditions, with the result that they wear in the same proportions. There is therefore no need to permutate the wheels.

FIG. 3 is a more particular illustration of the facility of the skate to adapt to irregularities in the ground. It can be seen that in the case shown the limit of pivoting of the yokes 8 and 12 relative to the chassis 5 has been reached, the front end of the top face of the rear yoke 12 bearing against the abutment 25.

Note also that the leaf spring 21 urges the wheels 7, 10 and 11 at all times into the configuration represented in FIG. 1.

Figure 4:
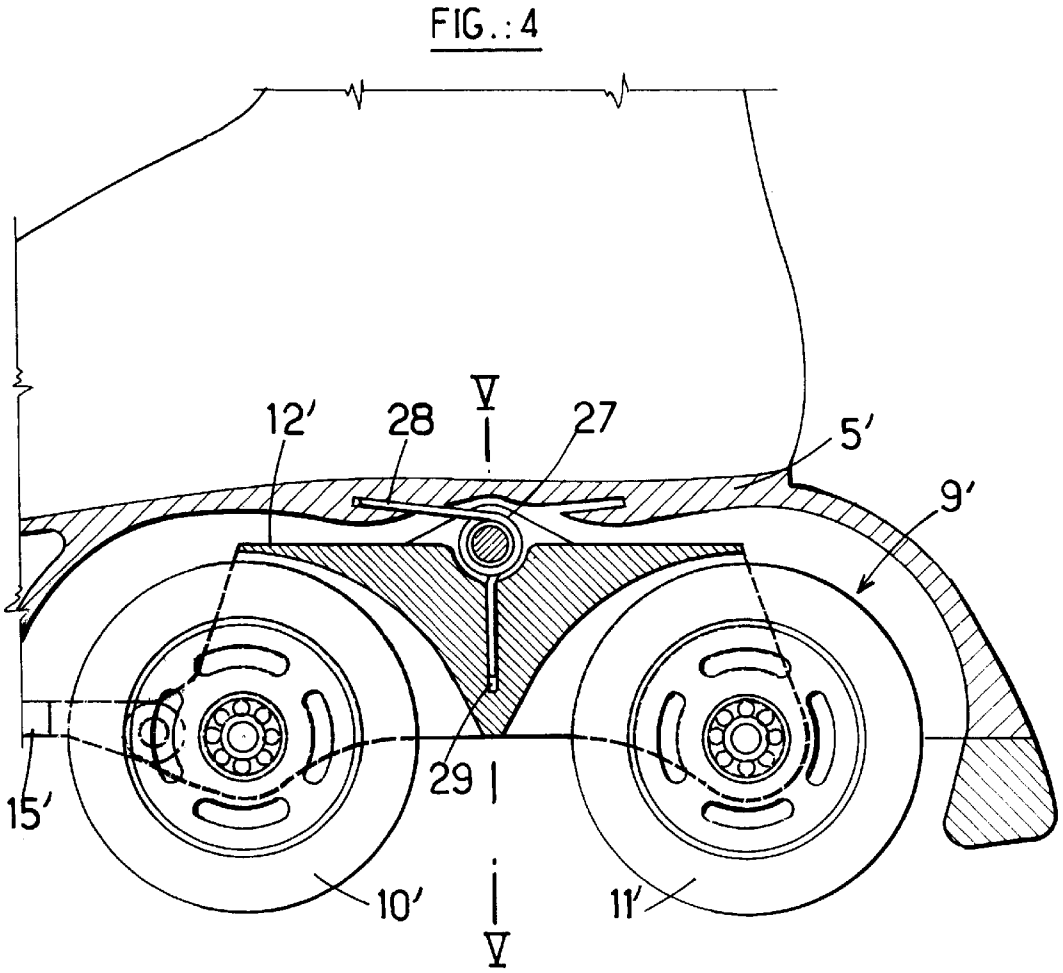
FIG. 4 is a partial profile view, partly in section, of another embodiment of the invention.
Figure 5:
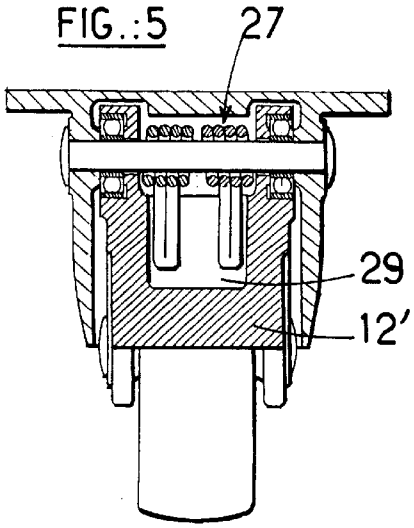
FIG. 5 is a view partly in section taken along the line V—V in FIG. 4.

FIGS. 4 and 5 represent another embodiment of the skate of the invention using different return spring means for the rear wheel unit 9' comprising the rear yoke 12' carrying the two wheels 10' and 11', this yoke being coupled to the front wheel unit (not shown) by the link 15'.

In this case, the pin pivoting the rear yoke 12' to the chassis 5' carries a double coil spring 27 the ends of which are respectively trapped in blind holes 28 and 29 in the chassis 5' and the yoke 12'.

Figure 6:
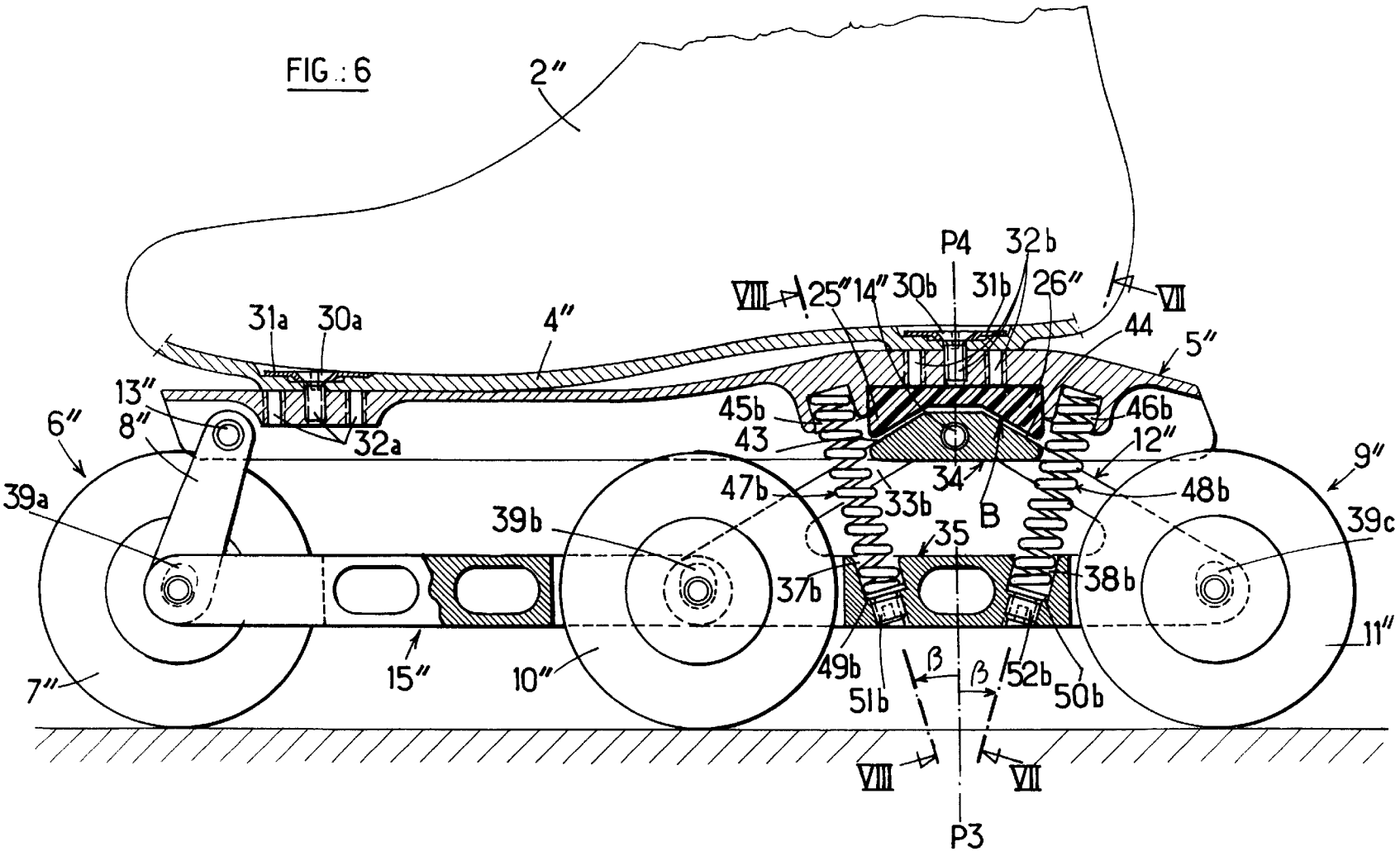
FIG. 6 is a profile view partly in section of another embodiment of skate of the invention.
Figure 8:
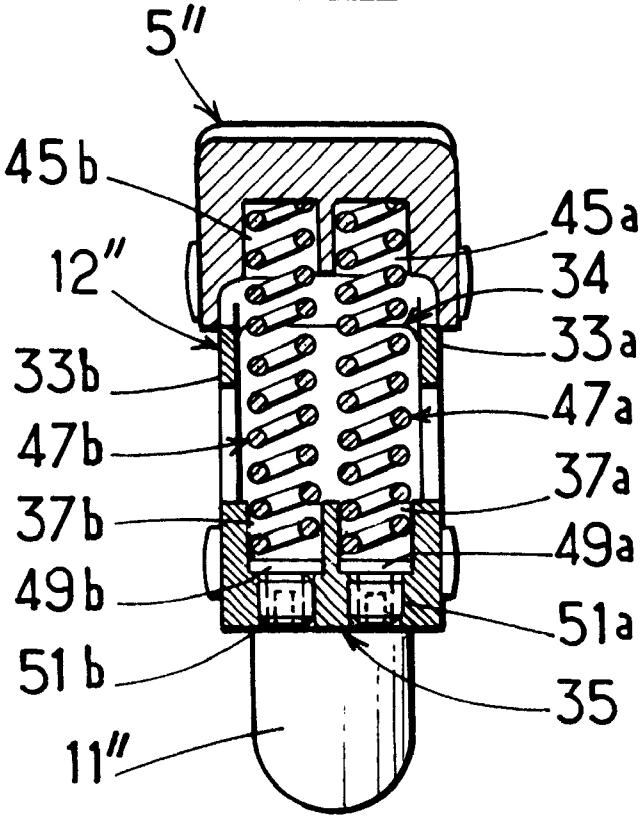
FIG. 8 is a partial view in section taken along the line VIII—VIII in FIG. 6.
Figure 7:
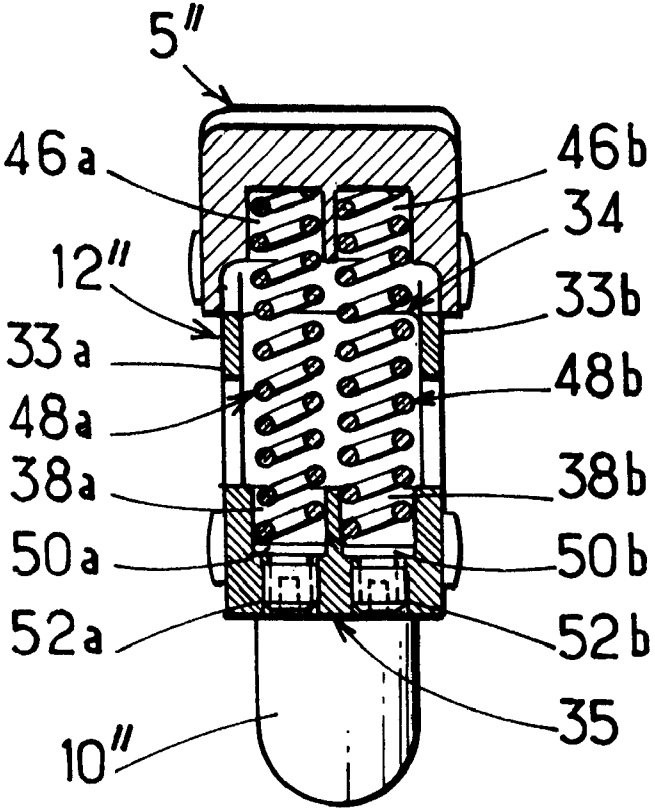
FIG. 7 is a partial view in section taken along the line VII—VII in FIG. 6.

FIGS. 6, 7 and 8 show another embodiment of the skate in accordance with the invention featuring a number of detail modifications and again using different return spring means for the rear yoke 12".

FIG. 6 shows that the shoe 2" is fixed to the skate by screws 30*a*, 30*b* that pass through the sole 4" and bear on washers 31*a*, 31*b*.

These screws are screwed into screwthreaded holes 32*a*, 32*b* in the chassis 5". There can be a plurality of screwthreaded holes 32*a*, 32*b* in the chassis so that the longitudinal position of the shoe can be adjusted to suit the weight of the skater and how he or she intends to use the skates, in particular to achieve improved longitudinal balance.

The front wheel unit 6" includes a front yoke 8" consisting of a simple fork straddling the front wheel 7" which is mounted to rotate about a pin 13" transverse to the direction of forward movement of the skate.

FIGS. 6, 7 and 8 show that the rear wheel unit 9" includes a rear yoke 12" including two substantially isosceles triangle-shape members 33*a*, 33*b* disposed side-by-side and connected by first and second connecting blocks 34 and 35 respectively disposed between the obtuse angle corners and the middles of the longer sides of these triangles.

The two members 33*a* and 33*b* can be fixed to the first and second connecting blocks 34 and 35 by screwing, gluing, welding, etc. The two members 33*a* and 33*b* and the connecting blocks 34 and 35 are preferably moulded in one piece.

The second connecting block 35 is substantially parallelepiped-shape. It has a first pair of cylindrical orifices 37*a*, 37*b* with axes inclined at an angle β to its median plane P3 and a second pair of cylindrical orifices 38*a*, 38*b* symmetrical to the first pair about this median plane (see FIG. 6).

The angle β is in range 0° to 30° and is preferably equal to 15°.

The orifices 37*a*, 37*b*, 38*a*, 38*b* are screwthreaded in their bottom part which in use faces the ground.

The rear yoke 12" is mounted on the chassis 5" to rotate about a pin 14" transverse to the direction of forward movement of the skate and passing through the first block 34.

The rear yoke 12" carries two wheels 10", 11" between the acute angle corners of the triangular members 33*a*, 33*b*.

A double link 15" similar to that described previously is mounted directly on the bearings whereby the front wheel 7" and the intermediate wheel 10" are mounted to rotate in their respective yokes 8" and 12".

The bearing of the three wheels of the skate include bearing blocks 39*a*, 39*b*, 39*c* made from a hard material such as PTFE. These pads constitute replaceable parts avoiding the need to replace all of the yokes when the bearings of the wheel are worn out.

The chassis 5" incorporates first and second abutments 25" and 26" in vertical alignment with the rear ends 43 and 44 of the first connecting block 34, respectively. These abutments have the same function as the abutments 25 and 26 previously described.

As shown in FIG. 6, these abutments are preferably formed in a single block B of hard rubber or PTFE recessed into the bottom of the chassis and fixed by appropriate means (force fit, screwing, gluing, etc). In this case the dimensions of the abutments are such that they project slightly from the chassis 5". This avoids metal-to-metal contact between the connecting block 34 and the chassis 5", which is more comfortable.

The chassis 5" includes a first pair of cylindrical housings 45*a*, 45*b* adjacent the first abutment 25", the axes of these housings being inclined at the same angle β as mentioned hereinabove to a plane P4 perpendicular to the chassis 5" and containing the pin 14" (see FIG. 6).

The chassis 5" also includes a second pair of cylindrical housings 46*a*, 46*b* symmetrical to the first pair 45*a*, 45*b* about the plane P4.

The housings 45*a*, 45*b*, 46*a*, 46*b* are positioned so that their axes coincide with those of the respective orifices 37*a*, 37*b*, 38*a*, 38*b* when the planes P3 and P4 are coincident, i.e. when the three wheels of the skate are resting on a plane surface, as shown in FIG. 6.

This skate also includes spring return means disposed between the rear yoke 12" and the chassis 5".

FIGS. 6, 7 and 8 show that these means comprise first and second pairs of coil springs 47*a*, 47*b* and 48*a*, 48*b*, the two springs of the same pair being substantially parallel to each other.

When the three wheels of the skate are resting on a plane surface, the two pairs of springs are substantially symmetrical to each other about the planes P3, P4.

FIGS. 7 and 8 show that the top ends of the springs 47*a*, 47*b* bear in housings 45*a*, 45*b* formed in the chassis 5" and the top ends of the springs 48*a*, 48*b* bear in the housings 46*a*, 46*b*.

The bottom ends of the springs 47*a*, 47*b* bear against respective washers 49*a*, 49*b* in the housings 37*a*, 37*b* formed in the second connecting block 35, these washers in turn bearing on respective micrometer screws 51*a*, 51*b* engaged in the screwthreads of the housings 37*a*, 37*b*.

Similarly, the bottom ends of the springs 48*a*, 48*b* bear against respective washers 50*a*, 50*b* in the housings 38*a*, 38*b* formed in the second connecting block 35, these washers in turn bearing on respective micrometer screws 52*a*, 52*b* engaged with the screwthreads of the housings 38*a*, 38*b*.

In this embodiment the spring return means of the rear yoke 12" have the advantage of being easy to fit in a mass production context and of being very robust.

It is also possible to choose the springs so that the first pair 47*a*, 47*b* has a different stiffness than the second pair 48*a*, 48*b*.

It is advantageous to use a first relatively more flexible pair of springs and a second relatively stiffer pair of springs.

This configuration enables obstacles and asperities in the ground to be crossed more comfortably and avoids the skater falling over backwards.

Finally, note that the micrometer screws 51*a*, 51*b*, 52*a*, 52*b* can be used to modify the adjustment obtained with given springs, in particular as a function of the position of the shoe 2" relative to the chassis 5", the weight of the skater and the type of skating performed (relatively unskilled, artistic, speed skating, etc).

Of course, the invention is not limited to the embodiments described and shown which have been given by way of example only. For example, in the last embodiment described, each pair of springs could be replaced by an equivalent single spring.

What is claimed is:

1. A skate with in-line wheels comprising a chassis having a bottom, a shoe mounted on the chassis, a front wheel unit, a rear wheel unit said in line wheels being mounted in said wheel units, a front pivot pin, a rear pivot pin, said front and rear wheel units pivoting on the chassis about the respective front and rear pivot pins the axes of said pins being transverse to the direction of movement of the skate and a coupling link for coupling said front and rear wheel units together for causing them to pivot together and in the same direction about their respective pivot pins.

2. A skate according to claim 1, wherein said wheel units each comprise a yoke for rotatably mounting the wheels, and said coupling link is articulated about respective axes to the yokes.

3. A skate according to claim 2, wherein said yokes include lateral branches and wherein said link includes, a stretcher having side-members and a connecting part, said side members being respectively articulated to the lateral branches of said yokes, the side-members being joined together by said connecting part located between the yokes.

4. A skate according the claim 2, wherein said link is articulated to said yokes about axes offset relative to the rotation axes of the wheels.

5. A skate according to claim 2, wherein said link is articulated to said yokes about axes that coincide with the rotation axes of said wheels.

6. A skate according to claim 3, wherein said wheels have rotational axes and wherein, with all the wheels of the skate resting on plane ground, the articulation axes of said link to the front and rear wheel units are in a plane passing through the rotational axes of said wheels.

7. A skate according to claim 1, wherein a single one of said wheels is mounted in the front wheel unit and two of said wheels are mounted in the rear unit.

8. A skate according to claim 7, wherein, when all the wheels of the skate are resting on plane, horizontal ground, the front pivot pin is located to the rear of a vertical plane passing through the rotation axis of said wheel mounted in said front wheel unit.

9. A skate according to claim 8, wherein, when all the wheels of the skate are resting on plane horizontal ground, the axis of the front pivot pin and the rotation axes of the front wheel define a plane inclined to said vertical plane towards the rear of the skate at angle in the range 0° to 15° inclusive.

10. A skate according of claim 1, further including spring return means for urging said wheel units into a position in which all the axes of the wheels are in the same plane.

11. A skate according to claim 10, wherein said rear wheel unit includes a top face having front and rear ends and wherein said spring return means comprise a leaf spring having a middle fixed to the bottom of the chassis and ends respectively bearing on said front and rear ends.

12. A skate according to claim 10, wherein said chassis and said rear wheel unit include opposing blind holes and wherein said spring means include a double coil spring mounted around the rear pivot pin and having ends trapped in opposing ones of said blind holes.

13. A skate according to claim 10, wherein said spring means include at least first and second coil springs mounted between the chassis and the rear wheel unit on either side of the rear pivot pin.

14. A skate according to claim 13, further including opposing housings formed the bottom of said chassis and in the rear wheel unit, washers disposed in the housings in said rear wheel unit, and first and second pairs of coil springs the top ends of which respectively bear in the housings formed in the chassis and the bottom ends of which respectively bear against said washers in said opposing housings, the springs of each pair being parallel to each other, and the two pairs of springs being substantially symmetrical about a plane perpendicular to the chassis and containing the rear pivot pin when the wheels of the skate are resting on a plane surface.

15. A skate according to claim 14, wherein the first and second pairs of springs are inclined at the same angle relative to said plane, this angle being about equal to 15°.

16. A skate according to claim 14 wherein housings in said rear wheel unit have screwthreaded parts, and micrometer screws engaged with said screwthreads, said washers respectively bearing on said micrometer screws.

17. A skate according to claim 14, wherein the stiffness of the springs of the first pair is lower than the stiffness of the springs of the second pair.

18. A skate according to claim 1, wherein the chassis comprises a plurality of screwthreaded holes enabling adjustment of the longitudinal position of the shoe relative to the chassis.

19. A skate according to the claim 1, wherein a block of a hard resilient material including first and second projections forming abutments is recessed in the bottom of the chassis at the rear of the latter for limiting movement of said rear wheel unit.

20. A skate according to claim 1, wherein said front and rear pivot pins are mounted in said chassis.

* * * * *

UNITED STATES PATENT AND TRADEMARK OFFICE

CERTIFICATE OF CORRECTION

PATENT NO. : 6,196,557 B1
DATED : March 6, 2001
INVENTOR(S) : Gérard Claude Millot It is certified that error appears in the above-identified patent and that said Letters Patent is hereby corrected as shown below:

Title page,
Line 2, change "Gérard" to -- Millot --;
Line 2, change the name of the inventor from "Claude Millot Gérard" to -- Gérard Claude Millot --

Signed and Sealed this

Twenty-sixth Day of February, 2002

*Attest:*

*Attesting Officer*

JAMES E. ROGAN
*Director of the United States Patent and Trademark Office*